US009687683B2

(12) United States Patent
Jones et al.

(10) Patent No.: US 9,687,683 B2
(45) Date of Patent: Jun. 27, 2017

(54) BRACKET FIXING FOR A SAFETY LINE

(75) Inventors: Owain Jones, Devizes (GB); Karl Jones, Devizes (GB)

(73) Assignee: Latchways PLC, Wiltshire (GB)

( * ) Notice: Subject to any disclaimer, the term of this patent is extended or adjusted under 35 U.S.C. 154(b) by 492 days.

(21) Appl. No.: 13/392,469

(22) PCT Filed: Sep. 1, 2010

(86) PCT No.: PCT/GB2010/001654

§ 371 (c)(1),
(2), (4) Date: Apr. 25, 2012

(87) PCT Pub. No.: WO2011/027110

PCT Pub. Date: Mar. 10, 2011

(65) Prior Publication Data

US 2012/0267194 A1 Oct. 25, 2012

(30) Foreign Application Priority Data

Sep. 2, 2009 (GB) ..... 0915281.0

(51) Int. Cl.
*A62B 35/00* (2006.01)
*E04G 21/32* (2006.01)

(52) U.S. Cl.
CPC ..... *A62B 35/0068* (2013.01); *A62B 35/0087* (2013.01); *E04G 21/3261* (2013.01); *A62B 35/0043* (2013.01)

(58) Field of Classification Search
CPC ..... A62B 35/0056; A62B 35/0068; A62B 35/0043
USPC ..... 182/3, 45, 100; 411/103, 132–134, 204, 411/324, 386, 402
See application file for complete search history.

(56) References Cited

U.S. PATENT DOCUMENTS

| | | | | |
|---|---|---|---|---|
| 2,140,628 | A * | 12/1938 | Hoff | 403/21 |
| 2,339,034 | A | 1/1944 | Siska | |
| 4,830,531 | A * | 5/1989 | Condit et al. | 403/348 |
| 5,343,975 | A * | 9/1994 | Riches et al. | 182/3 |
| 5,350,037 | A * | 9/1994 | Ghahremani | 182/3 |
| 7,207,414 | B2 * | 4/2007 | Luke et al. | 182/3 |
| 7,946,539 | B2 * | 5/2011 | Lara | 248/65 |
| 8,001,904 | B2 * | 8/2011 | Maes et al. | 104/112 |
| 8,424,638 | B1 * | 4/2013 | Guthrie et al. | 182/3 |
| 2003/0111293 | A1 * | 6/2003 | Desjardins et al. | 182/36 |
| 2006/0016636 | A1 * | 1/2006 | Durbic | 182/3 |
| 2006/0263170 | A1 * | 11/2006 | Poldmaa | 411/401 |

(Continued)

FOREIGN PATENT DOCUMENTS

| | | |
|---|---|---|
| DE | 20317251 U1 | 3/2004 |
| GB | 2119720 | 11/1983 |

(Continued)

OTHER PUBLICATIONS

International Search Report dated Jan. 7, 2011 for related PCT Application No. PCT/GB2010/001654.

*Primary Examiner* — Colleen M Chavchavadze
(74) *Attorney, Agent, or Firm* — Troutman Sanders LLP; Ryan A. Schneider

(57) ABSTRACT

A bracket fixing for securing a safety line to a structure, has a safety line receiving portion and a fixing portion connected to the safety line receiving portion, the fixing portion having a captive mechanical fixing, arranged to engage with and secure the bracket to the structure.

13 Claims, 5 Drawing Sheets

(56) References Cited

U.S. PATENT DOCUMENTS

| | | | | |
|---|---|---|---|---|
| 2007/0144830 | A1* | 6/2007 | Mastenbroek | 182/3 |
| 2009/0116930 | A1* | 5/2009 | Reimler | 411/337 |
| 2010/0187040 | A1* | 7/2010 | Siemienowicz | 182/3 |
| 2013/0168528 | A1* | 7/2013 | Patton | A62B 35/0068 248/548 |

FOREIGN PATENT DOCUMENTS

| | | | | | |
|---|---|---|---|---|---|
| GB | 2466054 | B | * | 11/2014 | A62B 35/04 |
| LU | EP 2687267 | A1 | * | 1/2014 | A62B 35/0068 |
| NL | EP 2615225 | A2 | * | 1/2012 | A62B 35/0068 |
| WO | 02092171 | | | 11/2002 | |
| WO | WO 2005037378 | A1 | * | 4/2005 | A62B 35/04 |

* cited by examiner

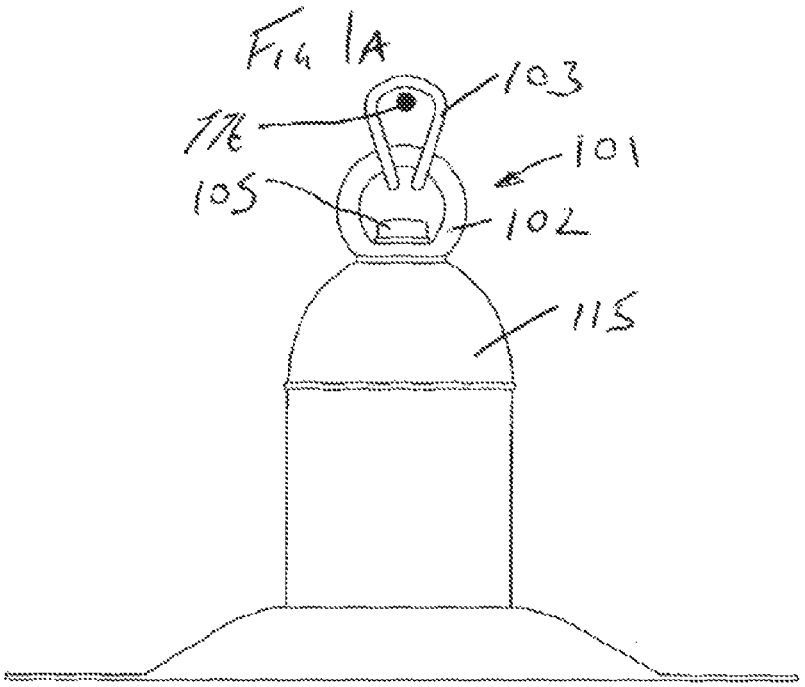
-- PRIOR ART --
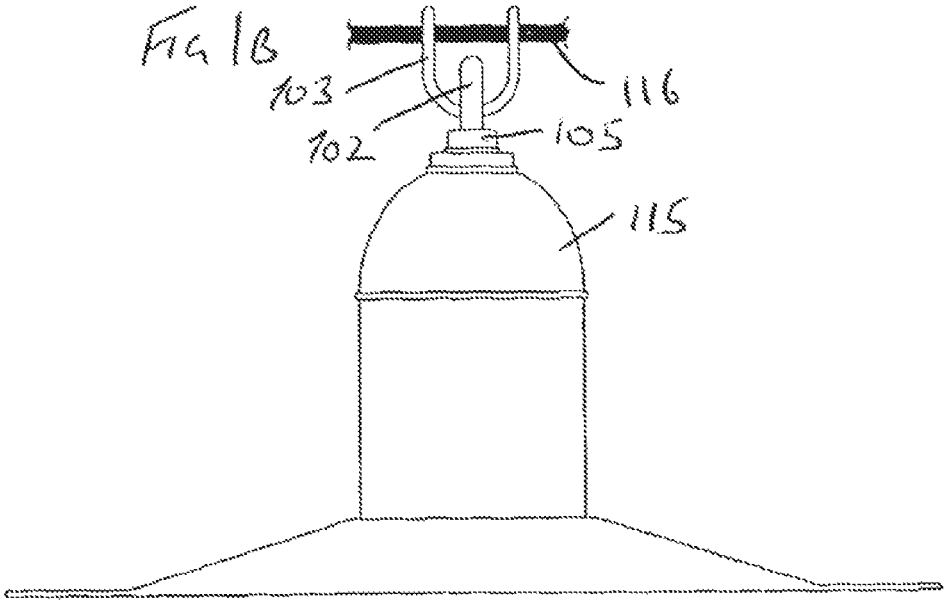
-- PRIOR ART --

1
3
4
5
Intermediate bracket assembly containing:
Bracket
Washer
Screw
Cover
Washer
Post Dome 1
15
17

BRACKET FIXING FOR A SAFETY LINE

CROSS-REFERENCE TO RELATED APPLICATIONS

This application is a US National Stage of International Application No. PCT/GB2010/001654, filed 1 Sep. 2010, which claims the benefit of GB 0915281.0, filed 2 Sep. 2009, both herein fully incorporated by reference.

FIELD OF THE INVENTION

The present invention relates to a bracket fixing for a safety line for a fall arrest system.

BACKGROUND OF THE INVENTION

In order to protect personnel from falls when working at height it is usual and often a legal requirement, to provide an elongate safety line running across a length of the area in which the personnel are to work. The personnel are attached to the safety line by a lanyard which is provided with a traveller to which the lanyard is secured. The traveller is fixed to the safety line such that it can travel along the safety line. The flexible lanyard is connected at its other end to a harness worn by the user. When connected the user can move with respect to the safety line, tension on the lanyard as the user moves causes the traveller to be dragged to move along the safety line.

The safety line is anchored at each end. In order to allow a long uninterrupted length of safety line a number of intermediate supports are typically provided to support the safety line at predetermined positions along its length. The traveller and supports are designed to cooperate such that the traveller can automatically pass the along the safety line past the intermediate supports with the minimum of interference or drag. The supports are typically in the form of metal brackets which are secured or anchored either into specifically designed support posts or into anchor sockets or points provided integrally in structures such as masonry walls or welded to steelwork Such a safety line system having intermediate supports and a traveller arranged to pass along the safety line past the intermediate supports is disclosed in for example WO02/092171. In the system disclosed the intermediate supports are provided with deflector or guide surfaces arranged to abut the traveller on approach to the intermediate support so as to re-orientate the traveller to enable smooth passage past the intermediate support.

In so called horizontal systems (often used on roof top structures) the safety line is typically positioned at waist height and the user often lifts the lanyard held in one hand when walking adjacent the safety line. The intermediate brackets are typically mounted upon support posts and may for example be fixed by means of a screw threaded bolt passing through an aperture in a flange portion of the support bracket. In such an arrangement the top of the support post would typically be provided with a screw threaded docking bore to receive the threaded shaft of the bolt for securing the bracket.

An alternative prior art arrangement is shown in FIGS. 1A and 1B. The bracket 101 comprises a D ring fixing 102 for securing to a post 115 or other structure. The top of the post is provided with a threaded bore for accepting the threaded shaft of a fixing bolt 105. The D ring fixing 102 is first positioned on the post and the bolt is then inserted and tightened to secure the D ring fixing 102 and the hanger 103 to the post. The safety line (which is typically a metal cable 116) passes through the hanger 103 and is tensioned.

BRIEF SUMMARY OF THE INVENTION

An improved arrangement has now been devised.

According to a first aspect, the invention provides a bracket fixing for securing a safety line to a structure, the bracket fixing comprising:

a safety line receiving portion, a fixing portion connected to the safety line and having a captive mechanical fixing arranged to engage with and secure the unitary bracket to the structure.

In a preferred embodiment, the safety line receiving portion may comprise an elongate (preferably cylindrical) tube portion for receiving the safety line.

The safety line receiving portion may be spaced from the tube portion in a direction transverse to the elongate tube portion.

It is preferred that the fixing has an axis extending in a direction away from the safety line, more preferably extending in a direction transverse to the elongate tube portion or the safety line.

It is preferred that the fixing further comprises a connecting web element connecting the tube portion to the fixing portion.

Beneficially, the mechanical fixing has an axis extending in a direction away from the elongate tube portion or the safety line axis, the axis being aligned with the direction in which the web portion extends.

It is preferred that the bracket fixing (particularly the fixing portion) is configured to be rotated about an axis to secure the mechanical fixing with the structure. The bracket can then be held rotationally in place by the safety line.

In one embodiment, it is preferred that the mechanical fixing comprises a screw threaded shaft for screw threaded engagement to secure the bracket fixing to the structure. A bolt may be used for this purpose, with, for example the bolt head held captive with respect to the fixing portion of the bracket fixing.

In an alternative embodiment the mechanical fixing may comprise a bayonet fixing, for example.

These are examples of systems employing rotational re-orientation of the mechanical fixing to ensure securing in position. Beneficially this is used in addition to male/female engagement, where a male portion is inserted into a female socket.

The bracket fixing is provided as an integrated assembly or unit comprising the safety line receiving portion, the fixing portion and the mechanical fixing arranged to engage with and secure the unitary bracket to the structure. The elongate tube portion for receiving a safety line, (when comprising the safety line receiving portion) provides a convenient hand piece to aid insertion and securing of the captive fixing in order to secure the bracket fixing.

The fixing portion may be a separate component to the safety line receiving portion, but in accordance with the invention the separate components are held captive with respect to one another so as to act and function as a unitary article.

In one embodiment the captivation of the mechanical fixing may be achieved by means of having a structure for holding a portion of the mechanical fixing member captive (for example holding the head of a bolt captive).

In one embodiment a first bracket element may be formed from a sheet deformed to form the elongate tube portion, and a fixing portion. This may include a box or claw structure formed about a part of the mechanical fixing in order to hold the mechanical fixing captive. A connecting web element connecting the tube portion to the fixing portion, may be formed from first and second portions of the sheet arranged face adjacent face.

As described, in one embodiment the mechanical fixing may comprise a bolt and the fixing portion may be formed about the head of the bolt to hold the bolt head captive.

The bracket fixing is distinct from prior art technology because, as defined in other ways, the mechanical fixing is set in a pre-fixed relationship with the tube portion and fixing portion before deployment to secure the bracket fixing to the structure. It is advantageous that the fixing portion may be a separate component to the safety line receiving portion, and in accordance with the invention the separate components are held captive with respect to one another so as to act and function as a unitary article. This provides an extremely efficient way to produce a technically functional product and enables mass produced bolts (for example) to be used.

According to a further aspect, the invention provides a bracket fixing for securing a safety line to a structure, the bracket fixing comprising:

a safety line receiving portion, a fixing portion connected to the safety line receiving portion;

wherein the bracket fixing is configured to be engaged with a receiving structure and rotated about an axis to secure the mechanical fixing with the receiving structure.

In a preferred embodiment the safety line receiving portion comprises an elongate tube portion for receiving the safety line.

In one embodiment, the fixing portion is spaced from the tube portion in a direction transverse to the elongate tube portion According to a further aspect, the present invention provides a method of setting up a safety line using a plurality of bracket fixings in accordance with earlier aspects of the invention, wherein for the respective bracket fixings the mechanical fixing is set in a pre-fixed relationship with the tube portion and fixing portion of a respective before deployment to secure the bracket fixing to the structure.

According to a further aspect, the present invention provides a safety line system comprising:

a plurality of bracket fixings for securing a safety line to a structure, a bracket fixing comprising; a safety line receiving portion; a fixing portion connected to the safety line receiving portion;

one or more respective receiving structures, the bracket fixing being configured to be engaged with a receiving structure and rotated about an axis to retain the mechanical fixing with the receiving structure;

a safety line strung via the bracket fixings and tensioned such that the presence of the safety line inhibits rotation of the respective bracket fixing to a position in which the bracket fixing can be disengaged from the receiving structure.

In an exemplary realisation, this provides that the bracket fixing is prevented from twisting back to a release position by the tensioned safety line passing through the receiving portion of the bracket.

BRIEF DESCRIPTION OF THE DRAWINGS

The invention will now be further described in specific embodiments, by way of example only, and with reference to the accompanying drawings, in which;

FIGS. 1A and 1B are schematic side views of a prior art safety line bracket and support post;

DETAILED DESCRIPTION OF PREFERRED EMBODIMENTS

Figure 2:
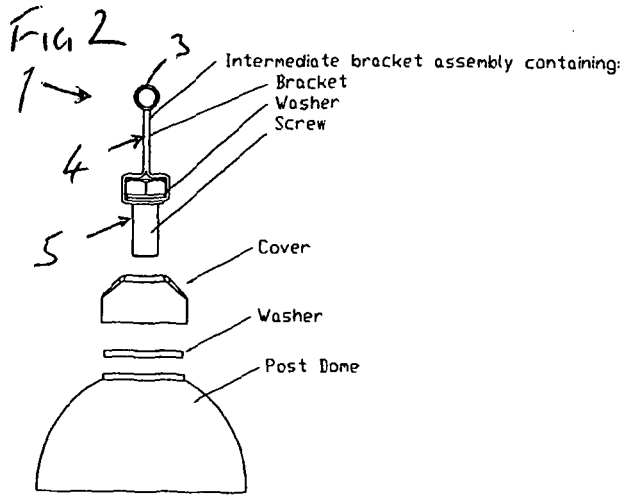
FIG. 2 is a schematic exploded view of a safety line bracket in accordance with the invention.
Figure 3:
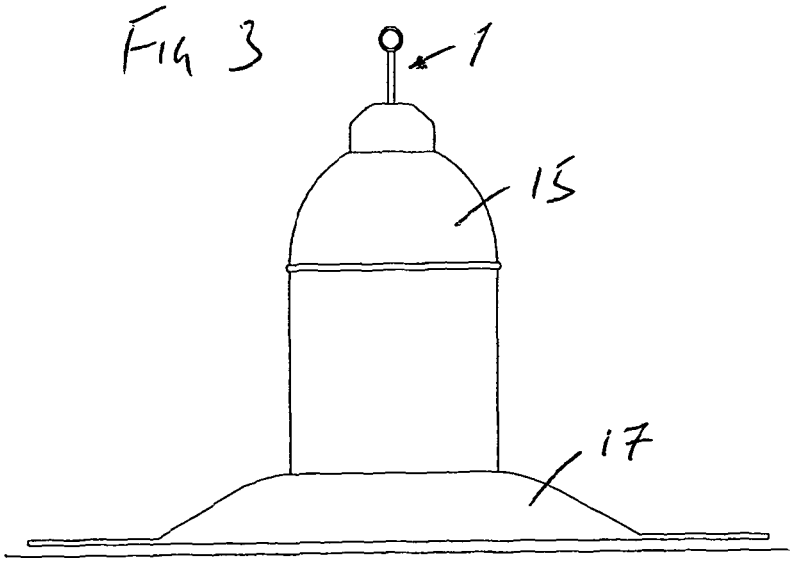
FIGS. 3 to 5 are end, side and plan views respectively of a support post structure fitted with bracket fixing according to the invention.
Figure 4:
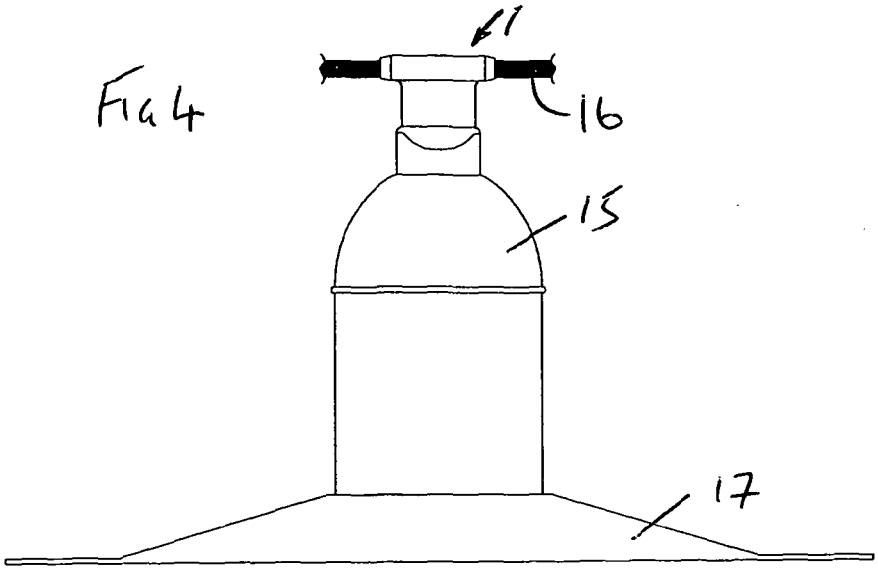
Figure 5:
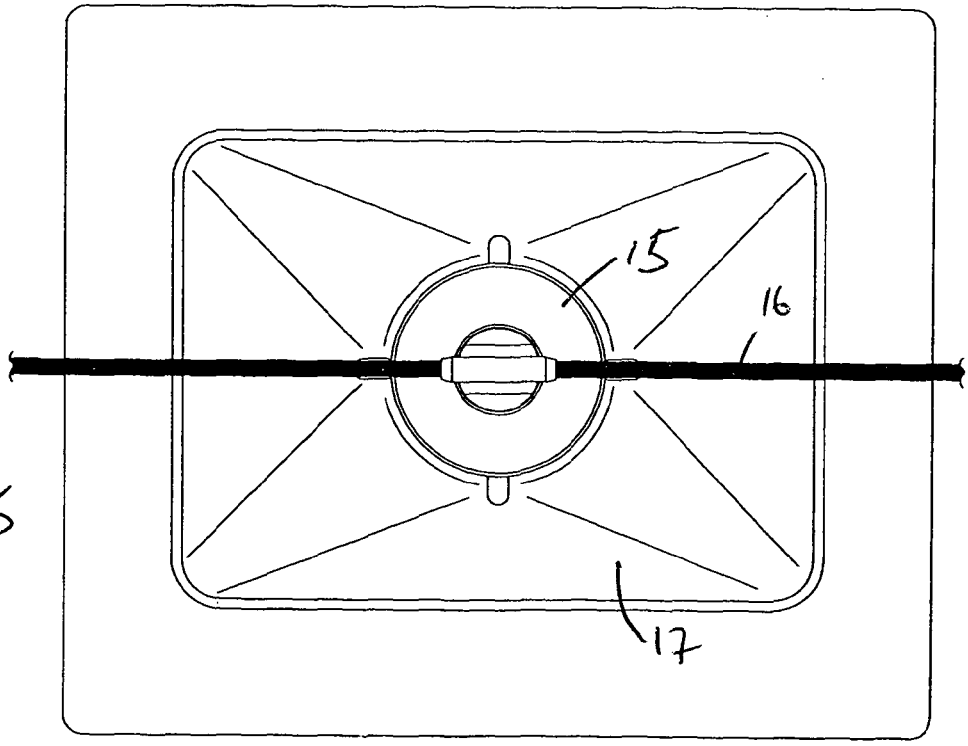
Figure 6:
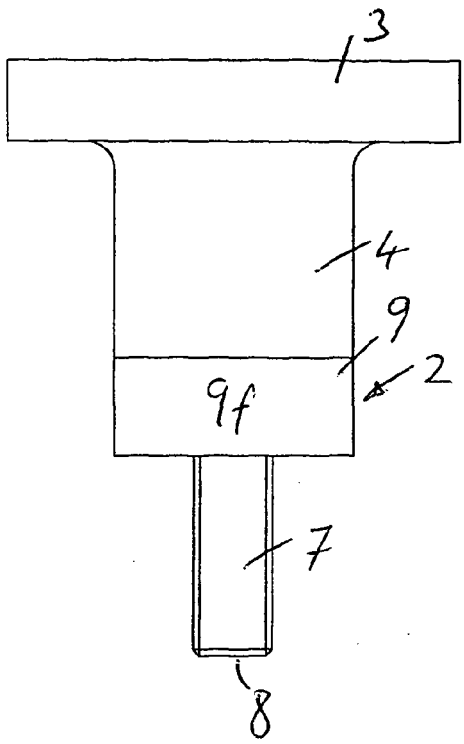
FIGS. 6 and 7 are side and end views respectively of the bracket fixing of FIGS. 2 to 5.
Figure 7:
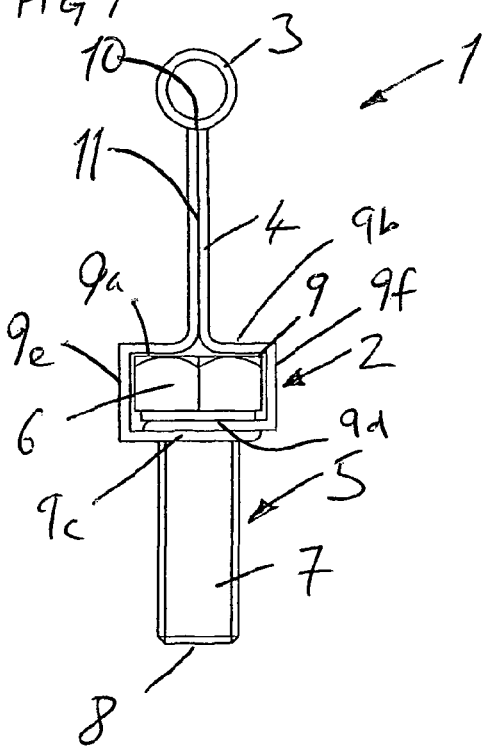
Figure 8:
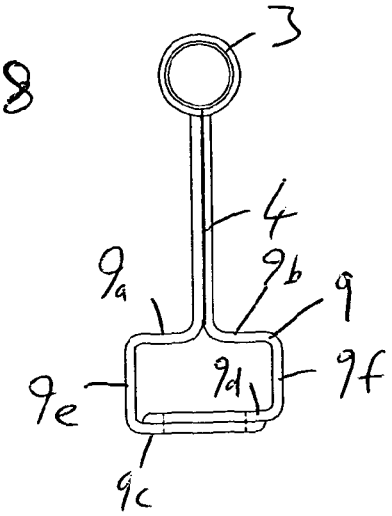
FIGS. 8 and 9 are side and underside views of the fixing.
Figure 9:
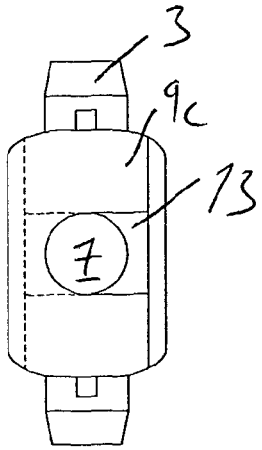
Figure 10:
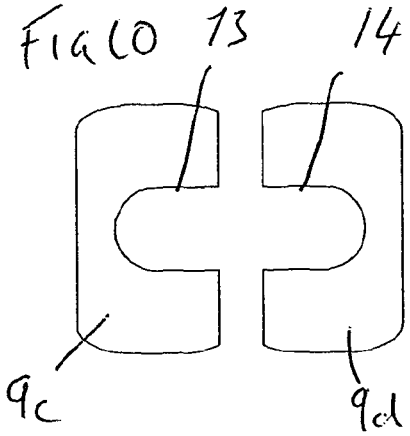
FIG. 10 shows the elements 9*c* and 9*d* separated for explanatory purposes.

Referring to the drawings, and particularly to FIG. 2 onwards, there is shown a safety line bracket fixing 1 mounted to a support post 15 to which is secured by means of a base plate 17 to a roof structure. The bracket fixing 1 secures the safety line 16 which is tensioned. In the embodiment shown, the safety line support bracket fixing 1 comprises a cylindrical tube portion 3 spaced from a fixing arrangement 2 by a narrow width upright web 4. The upright web 4 is narrow in width with respect to the diameter of the cylindrical tube portion 3, as can be seen clearly in FIG. 3, but also less extensive than the tube portion 3 in the axial direction of the cylindrical tube portion 3 as can clearly be seen in FIG. 2.

The fixing portion 2 of the bracket comprises a captivation structure in the form of a box structure 9 which holds captive the head 6 of a bolt 5 such that the threaded shaft 7 of the bolt projects away from the fixing portion to a distal end 8. The bolt is captured within the box structure 9 such that the bolt and its head are not able to rotate about the axis of the bolt relative to the box structure 9 or web 4 of the bracket.

In the embodiment shown, the tube portion 3, box structure 9 and interconnecting upright web portion are formed from a single piece of metal. The cylindrical tube 3 is curve formed of a single thickness wall, curved to meet at a seam 10, such that the web 4 extends downwardly and is of double wall thickness abutting at an interface 11. The separate walls are deformed outwardly at the base of the web 4 to form upper portions 9*a* 9*b* of the box structure 9. The material is deformed about the bolt head 6, and the free ends 9*c* and 9*d* overlap to capture the bolt head completely and securely in the box structure 9. The overlapping free ends are provided with slots 13 14 communicating with the terminal edge of the respective overlapping portions 9*c* 9*d* in order to accommodate the threaded shaft 7 of the bolt 5 when being deformed to the configuration shown. The sidewalls 9*e* 9*f* are a close fit abutment against the flats of the bolt head 6 such that the bolt head 6 is captive against rotation about the axis of the bolt within the box structure 9.

The bracket fixing 1, pre-loaded with the bolt 5, provides a unitary fixing which enables significant ease of installation and fixing in place. In use a bracket fixing 1 may be fixed simply by means of inserting the bolt 5, which is already loaded in the bracket, in a suitable threaded receiving socket (for example on a support post 15 or directly anchoring in to a structure). The bolt may be rotated or screwed home (to a locked or engaged position) by rotating the bracket fixing 1 in its entirety about the axis of the bolt 5, by hand. No specialist fixing tools or standard spanners or socket sets are required and the bolt does not need to be tightened to a high torque. Once the bracket fixings 1 are screwed into position the safety line can be fed through the cylindrical tube portions 3. The safety line is then tensioned and the system is securely set up.

In a variation on the fixing it will be appreciated that the threaded bolt 5 could be replaced by means of other mechanical fixing arrangements. For example a bayonet type mechanical fixing could be used. It is preferred that the mechanical fixing that is loaded to the bracket requires a male/female engagement and axial twisting to secure in position locked to the structure to which the bracket is mounted. This is because the axial twisting to an engaged or locked position mitigates against the fixing being disengaged by simply being pulled away from the structure. The bracket is prevented from twisting back to a release position by the tensioned safety line passing through the cylindrical tube portion of the bracket. It is particularly preferred from this aspect that the mechanical fixing carried on-board or loaded on the bracket fixing has a rotational fixing axis that is substantially in line with the direction of extension of the web 8 and/or positioned directly below the tube portion 3. This enables easier rotation and manipulation by hand.

In a variation on the fixing it will be appreciated that in accordance with the invention rather than a bolt or other mechanical fixing held captive in a box or claw structure 5 or other confinement structure, the fixing could be welded, fused or otherwise effectively permanently secured to the fixing portion of the bracket. This is however less preferred as using separate components held captive by a confinement structure provides advantages in terms of ease of production and the ability to use standard off the shelf components.

Furthermore it will be appreciated that other varieties of bracket fixing could be utilised. For example the D ring fixing of FIGS. 1A and 1B could be utilised with a captive bolt (or other mechanical fixing). This would be achieved by means of providing the d ring with a confinement or captivation portion such as the box structure 9 (or for example welding the bolt to the D ring).

The fixings as described are particularly usefully employed in retaining a safety line in position, because when the safety line is tensioned, the safety line itself provides a restraint against the fixings rotating loose.

The invention claimed is:

1. A bracket fixing for securing a safety line to a structure, the bracket fixing comprising:

a safety line receiving portion, and a fixing portion connected to the safety line receiving portion, the fixing portion having a captive mechanical fixing arranged to engage with and secure the bracket fixing to a structure;

wherein the fixing portion comprises a confinement structure in the form of a box structure, the captive mechanical fixing held captive in the confinement structure so as not to be rotatable independently of the bracket fixing, and so as not to be displaceable in a direction transverse to the safety line receiving portion independently of the bracket fixing;

wherein the captive mechanical fixing comprises a bolt and the box structure is formed to closely abut at least a portion of two opposing side surfaces of a head of the bolt;

wherein the confinement structure comprises first and second portions, each of the first and second portions comprising a terminal end; and wherein each of the terminal ends of the first and second portions abut and overlap with a terminal end of the other of the first and second portions to form the box structure that abuts against the bolt to prevent rotation of the bolt head within the box structure.

2. A bracket fixing according to claim 1, wherein the safety line receiving portion comprises an elongate tube portion for receiving a safety line.

3. A bracket according to claim 2, wherein the fixing portion is spaced from the tube portion in a direction transverse to the elongate tube portion.

4. A fixing according to claim 1, wherein the captive mechanical fixing has an axis extending in a direction away from a safety line.

5. A fixing according to claim 1, wherein the captive mechanical fixing has an axis extending in a direction transverse to a safety line.

6. A fixing according to claim 1 further comprising a connecting web element, wherein the safety line receiving portion comprises an elongate tube portion for receiving a safety line, and the connecting web element connects the tube portion to the fixing portion.

7. A fixing according to claim 6, wherein the captive mechanical fixing has an axis extending in a direction away from the elongate tube portion, the axis being aligned with the direction in which the web portion extends.

8. A fixing according to claim 1, wherein the bracket fixing is configured to be rotated about an axis to secure the captive mechanical fixing with a structure.

9. A fixing according to claim 1, wherein the bracket fixing is a unitary bracket fixing provided as an integrated assembly or unit comprising the safety line receiving portion, the fixing portion and the captive mechanical fixing arranged to engage with and secure the unitary bracket fixing to a structure.

10. A fixing according to claim 1 further comprising a first bracket element formed from a sheet deformed to form an elongate tube portion of the safety line receiving portion.

11. A fixing according to claim 10 further comprising a connecting web element connecting the elongate tube portion to the fixing portion, wherein the connecting web element comprises first and second portions of the sheet arranged face adjacent face.

12. A fixing according to claim 1, wherein the captive mechanical fixing is set in a pre-fixed captive relationship with the fixing portion before deployment to secure the bracket fixing to a structure.

13. A bracket fixing for securing a safety line to a structure, the bracket fixing comprising:

a safety line receiving portion, and a fixing portion connected to the safety line receiving portion, the fixing portion comprising a captive mechanical fixing and a confinement structure in the form of a box structure, for confining at least a portion of the captive mechanical fixing;

wherein the bracket fixing is configured to be engaged with a receiving structure and rotated about an axis to secure the captive mechanical fixing with the receiving structure;

wherein the captive mechanical fixing comprises a bolt with a head and a threaded portion, the head of the bolt held captive in the box structure such that the threaded portion of the bolt projects away from the fixing portion and formed to closely abut at least a portion of two opposing side surfaces of the head of the bolt;

wherein the bolt is held captive so as not to be rotatable independently of the bracket fixing, and so as not to be displaceable in a direction transverse to the safety line receiving portion independently of the bracket fixing;

wherein the confinement structure comprises first and second portions, each of the first and second portions comprising a terminal end; and wherein each of the terminal ends of the first and second portions abut and overlap with a terminal end of the other of the first and second portions to form the box structure that abuts against the bolt to prevent rotation of the bolt head within the box structure.

* * * * *